US010151524B2

(12) United States Patent
Ding et al.

(10) Patent No.: US 10,151,524 B2
(45) Date of Patent: Dec. 11, 2018

(54) REFRIGERATOR HAVING A DOOR

(71) Applicant: BSH HAUSGERAETE GMBH, Munich (DE)

(72) Inventors: Yuan Ding, Wuxi (CN); Ping Lv, Nanjing (CN); Xiaoguang Ren, Chuzhou (CN); Jicong Song, Nanjing (CN); Chuan Zhang, Chuzhou (CN); Changliang Zhao, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/319,027

(22) PCT Filed: Jul. 16, 2015

(86) PCT No.: PCT/IB2015/055373

§ 371 (c)(1),
(2) Date: Dec. 15, 2016

(87) PCT Pub. No.: WO2016/009374

PCT Pub. Date: Jan. 21, 2016

(65) Prior Publication Data

US 2017/0138658 A1 May 18, 2017

(30) Foreign Application Priority Data

Jul. 18, 2014 (CN) ..... 2014 2 0401725 U

(51) Int. Cl.
*F25D 23/02* (2006.01)

(52) U.S. Cl.
CPC ..... *F25D 23/028* (2013.01); *F25D 2400/361* (2013.01)

(58) Field of Classification Search
CPC ..... F25D 23/00; F25D 23/02; F25D 23/028; F25D 23/065
USPC ..... 312/401, 405, 109
See application file for complete search history.

(56) References Cited

U.S. PATENT DOCUMENTS

| | | | | |
|---|---|---|---|---|
| 4,966,004 | A * | 10/1990 | Midlang | F25D 29/005 200/302.2 |
| 8,485,617 | B2 * | 7/2013 | Park | F25D 23/028 312/405.1 |
| 9,459,041 | B2 * | 10/2016 | Park | F25D 23/028 |
| 2002/0184734 | A1 * | 12/2002 | Atalla | E05B 1/0015 16/110.1 |
| 2003/0145433 | A1 * | 8/2003 | Mandel | E05B 1/0015 16/436 |
| 2011/0273071 | A1 * | 11/2011 | Kim | F25D 23/028 312/405 |

(Continued)

FOREIGN PATENT DOCUMENTS

| | | | |
|---|---|---|---|
| CN | 1249395 | C | 4/2006 |
| EP | 2538160 | A2 | 12/2012 |
| JP | 2013178054 | A | 9/2013 |

*Primary Examiner* — James O Hansen
(74) *Attorney, Agent, or Firm* — Laurence A. Greenberg; Werner H. Stemer; Ralph E. Locher

(57) ABSTRACT

A refrigerator includes a door having a handle groove, a grip portion located in front of the handle groove, and a front panel located in front of the grip portion. The grip portion is close to a rear surface of the front panel or is in contact with the rear surface of the front panel. The door includes at least a metal reinforcement member disposed in the grip portion.

14 Claims, 7 Drawing Sheets

(56) References Cited

U.S. PATENT DOCUMENTS

2012/0326587 A1 12/2012 Jeong et al.

* cited by examiner

REFRIGERATOR HAVING A DOOR

BACKGROUND

Technical Field

The present invention relates to a refrigerator, and in particular, to a household refrigerator having a door.

Related Art

CN1249395C discloses a refrigerator. A door of the refrigerator has an outer plate of the door, an inner plate of the door, and a foam thermal insulating material between the inner plate and outer plate of the door. The door has a handle base across the outer plate and inner plate of the door. The handle base has a hole for the foam thermal insulating material to pass through and a grip portion. The door further includes a handle cover that is spaced from the grip portion and covers the handle base. The foam thermal insulating material enters space between the handle base and the handle cover through the hole, thereby reinforcing the adhesive strength between the door and the handle, and improving the strength of the handle.

JP 2013-178054 A discloses a refrigerator door, including a door main body having a thermal insulating layer. A user interface apparatus is disposed in a middle area seen from a vertical direction of the door main body, and is located behind a glass plate of the door main body. A step member that makes a front surface concave is formed on a side cover at a right end portion of the door main body. The step member closes an accommodating chamber that accommodates the user interface apparatus. A handle member protruding towards the right side is mounted, by using a screw, on a mounting surface facing a side surface of the step member. A handle groove extending over the entire height of the door is formed between the handle member and the step member. A front surface of a handle portion is covered by a protective cover clamped between a front end of the handle portion and the step member. The protective cover is formed by a transparent resin forming part.

SUMMARY

An objective of the present invention is to provide an improved refrigerator, so as to solve at least one technical problem in the prior art.

The foregoing objective may be implemented by means of characteristics in an independent claim. Preferred embodiments of the present invention are the subjects of the accompanying drawings, specification, and dependent claims.

One aspect of the present invention relates to a refrigerator. The refrigerator includes a door, and the door includes a handle groove, a grip portion located in front of the handle groove, and a front panel located in front of the grip portion, characterized in that, the grip portion is close to a rear surface of the front panel or is in contact with the rear surface of the front panel, and the door includes at least a metal reinforcement member disposed in the grip portion.

No obvious gap is formed between the grip portion and the front panel, which helps prevent dust from entering space between the grip portion and the front panel. Besides, due to the setting of the metal reinforcement member, the strength of the grip portion is significantly improved, thereby reducing the possibility that the grip portion is deformed and applies a force on the front panel when the door is opened. In other words, a relative position relationship between the front panel and the grip portion does not change significantly due to an increase in the number of times the door is opened. These can be implemented without combining the grip portion with the thermal insulating layer of the door.

The present invention is applicable to refrigerators of different structures. For example, the present invention is applicable to a side-by-side refrigerator having a first storage compartment and a second storage compartment arranged side by side, a refrigerator having a first storage compartment and a second storage compartment arranged along a vertical direction, and a refrigerator in which a pair of doors close a same storage compartment.

The storage compartment of the refrigerator may be used to store food and/or wine, for example, the refrigerator may have a storage compartment for storing only wine.

The door may be a rotatable door connected to a main body of the refrigerator in a hinged manner, or may be a draw-type door connected to a main body of the refrigerator and capable of being pushed and pulled.

The door may close one or more storage compartments of the refrigerator, or may close part of one or more storage compartments.

In a possible embodiment, the handle groove may be open towards a vertical side (such as a right side or a left side) of the door. In an alternative embodiment, the handle groove is open towards a horizontal side (such as a top side or a bottom side) of the door.

Other individual characteristics or characteristics that are combined with other characteristics and thus are regarded as features of the present invention will be illustrated in the following appended claims.

In a possible embodiment, the reinforcement member extends along a length direction of the grip portion.

In a possible embodiment, the metal reinforcement member is embedded in the grip portion.

In a possible embodiment, two ends of the grip portion are each connected to a corresponding boundary wall of the handle groove, each end portion of the grip portion has a slot close to the corresponding boundary wall, and the slot separates the metal reinforcement member and the corresponding boundary wall.

In a possible embodiment, the door includes a user interface electrical module close to the handle groove, and the user interface electrical module is connected to the rear surface of the front panel.

The user interface electrical module may include an input unit for receiving an instruction input by a user and/or an output unit for displaying information to a user.

In a possible embodiment, the door includes a user interface housing, the user interface housing has an accommodating space for accommodating the user interface electrical module, and the grip portion is connected on the user interface housing. The user interface electrical module may be completely located in the first accommodating space, or partially located in the first accommodating space and partially located outside the first accommodating space.

In a possible embodiment, the grip portion has a receiving portion, the receiving portion is open towards the accommodating space, and the reinforcement member is at least partially received in the receiving portion.

In a possible embodiment, the refrigerator includes a handle member detachably connected to the user interface housing, the handle member includes a cover portion for closing an entrance, which is open towards the handle groove, of the accommodating space, and the cover portion is integrally formed with the grip portion. The "detachable handle member" refers to that the handle member can be detached from the door without damaging the door, where a tool is used or no tool is used, and the handle member can be mounted on the door again. When the handle member is detached, the user interface module can be taken out of the first accommodating space or placed into the first accommodating space.

In a possible embodiment, the reinforcement member extends in the cover portion and the grip portion.

In a possible embodiment, the reinforcement member has a shape adapted to the grip portion and the cover portion.

In a possible embodiment, a gap exists between the grip portion and the rear surface of the front panel, and the gap is between 0.2 millimeters and 1 millimeter. Therefore, a front surface of the grip portion is disposed close to the front panel. This not only reduces the possibility of a foreign body entering the gap, but also significantly reduces the possibility of poor contact between the front panel and the user interface electrical module due to a force applied by the grip portion on the front panel when the grip portion is gripped to pull the door.

In a possible embodiment, the front panel forms at least the most of the front surface of the door.

In a possible embodiment, the front panel is detachably connected to the user interface housing.

The structure of the present invention and other invention objectives and beneficial effects thereof will be more comprehensible through description of preferred embodiments with reference to the accompanying drawings.

BRIEF DESCRIPTION OF THE DRAWINGS

As a part of the specification and provided for further understanding of the present invention, the following accompanying drawings illustrate specific implementation manners of the present invention, and are used for elaborating, together with the specification, the principle of the present invention, where.

DETAILED DESCRIPTION

Figure 1:
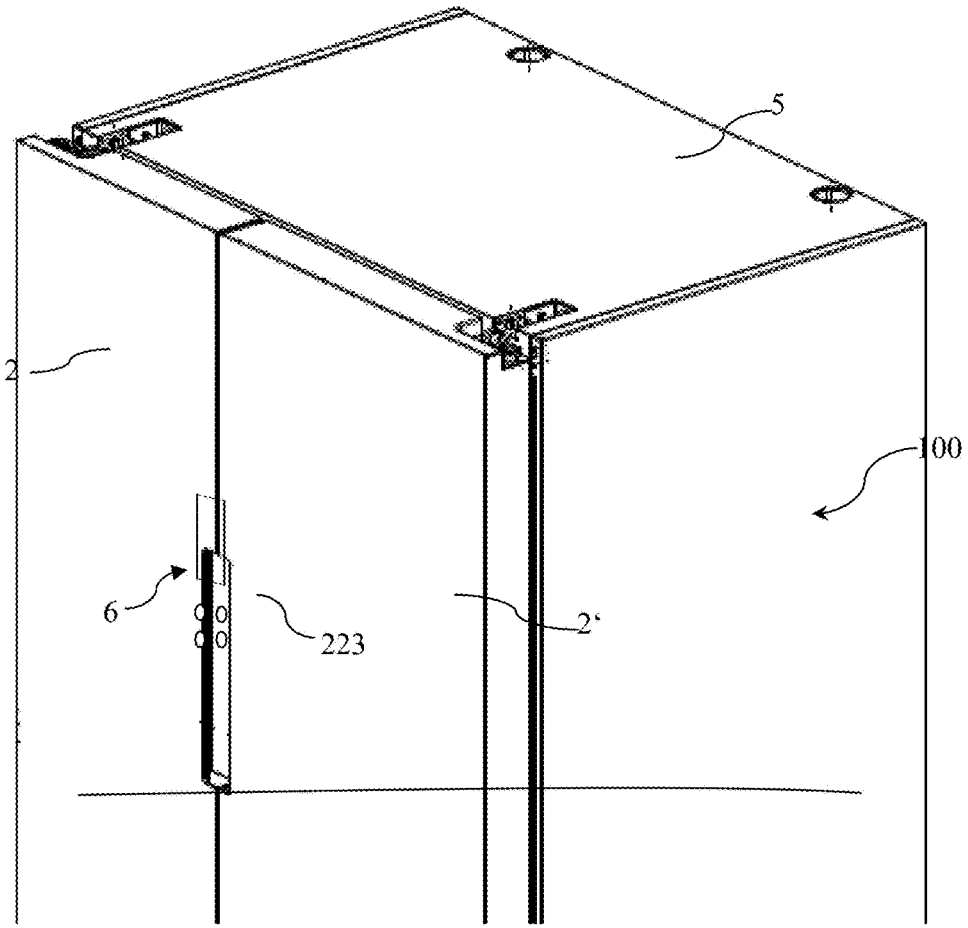
FIG. 1 is a partial three-dimensional schematic diagram of a refrigerator according to a preferred embodiment of the present invention.

FIG. 1 shows a three-dimensional schematic diagram of a refrigerator 100 according to a preferred embodiment of the present invention. As shown in FIG. 1, the refrigerator 100 includes a main body 5 that has a first storage compartment (not shown) and a second storage compartment (not shown) arranged side by side. The refrigerator 100 further includes a pair of side-by-side doors 2 and 2' that are connected to the main body 5, to separately close the corresponding storage compartments.

Figure 2:
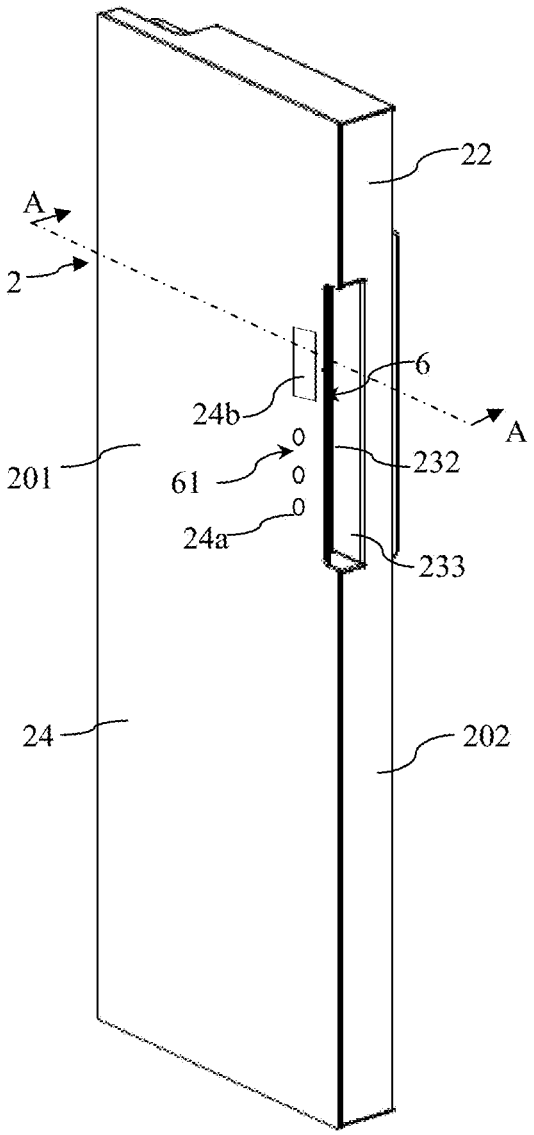
FIG. 2 is a partial three-dimensional schematic diagram of a door according to a preferred embodiment of the present invention.
Figure 3:
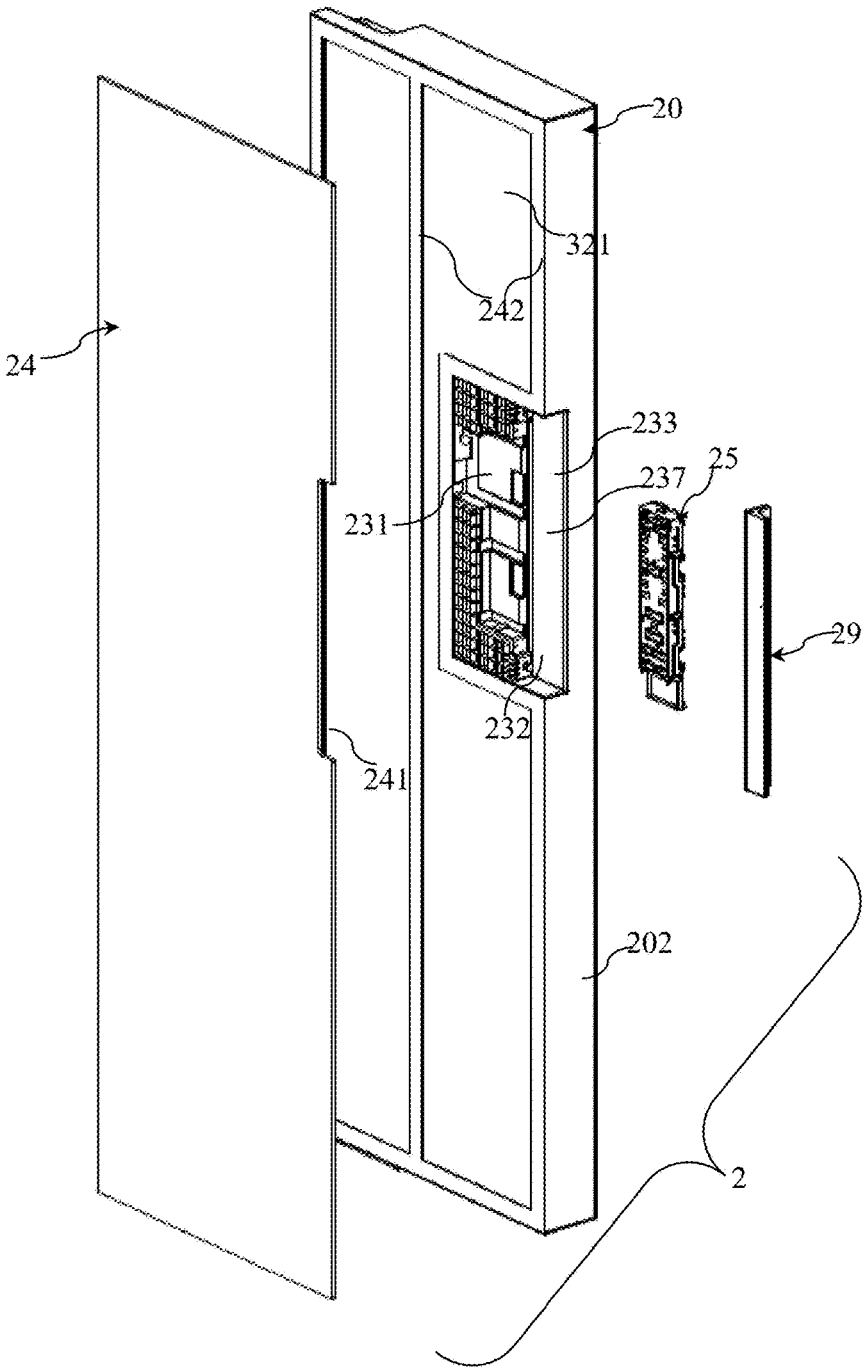
FIG. 3 is a partial exploded diagram of a door according to a preferred embodiment of the present invention.
Figure 4:
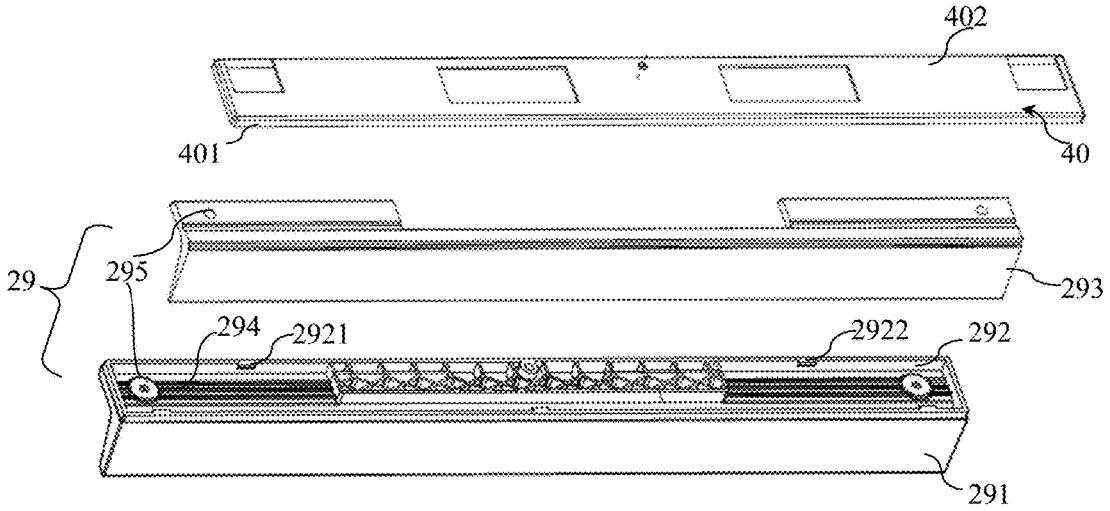
FIG. 4 is a partial cross-sectional diagram along line A-A in FIG. 2.

Referring to FIG. 2 to FIG. 4 in combination with FIG. 1, the door 2 has an integrated operation center 6. The operation center 6 includes a user interface 61 and a handle groove 232 integrated in the operation center 6. When the door 2 is opened or closed, a hand of a user may enter the handle groove 232. The operation center 6 further includes a concave portion 233 that is concave backwards, and the hand of the user enters the handle groove 232 through the concave portion 233.

The user interface 61 is configured to receive information input by the user and output information, and these information includes, for example, setting information about the refrigerator 100 and/or information about food stored in the refrigerator 100. The user interface 61 includes multiple touch areas 24*a* and a display area 24*b* that are formed on a front panel 24. The touch areas 24*a* may be separate from the display area 24*b*, as shown in FIG. 2, or may be located in the display area 24*b*.

The user interface 61 includes a user interface electrical module 25 that is located behind the touch areas 24*a* and the display area 24*b*. The user interface electrical module 25 may include a light source, and when the light source is switched on, light can travel through the display area 24*b*.

Figure 7:
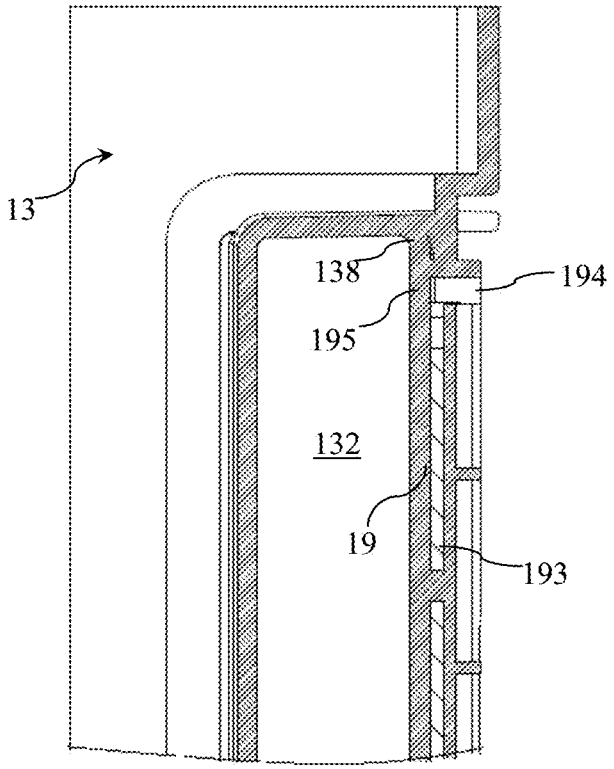

As shown in FIG. 7, the concave portion 233 is open towards a front surface 201 and a side surface 202 of the door 2. The concave portion 233, the handle groove 232, and the user interface electrical module 25 are arranged side by side along a depth direction of the handle groove 232 (which is also a horizontal direction of the door 2 in this embodiment). Seen from the front side, visible elements such as the touch areas 24*a* and the display area 24*b* of the user interface 61, the handle groove 232, and the concave portion 233 are sequentially disposed side by side along the horizontal direction of the door 2.

The door 2 includes a door main body 20 having a thermal insulating layer 27, and the front panel 24 provides coverage in front of the door main body 20. The front panel 24 has an edge notch 241 in front of the concave portion 233, so as to expose the concave portion 233 in front.

The front panel 24 may be made of glass or resin that looks like glass. The front panel 24 may be adhered to the door main body 20 by using an adhesion apparatus 242 that is disposed around at least a front edge of the door main body 20.

The door main body 20 may include a user interface housing 23. The user interface housing 23 may be constructed independent of a front wall 21 and a side wall 22 of the door main body and connected to the front wall 21 and the side wall 22. The user interface housing 23, the front wall 21, the side wall 22, and a door liner 26 are combined with the thermal insulating layer 27 that is located between the front wall 21 and a door liner 26.

Referring to FIG. 4, the user interface housing 23 has a dent that is concave backwards, so as to form, on the door 2, a first accommodating space 231 for accommodating the user interface electrical module 25 and a second accommodating space 237 alongside the first accommodating space 231. The second accommodating space 237 is open towards one side of the door 2.

The user interface housing 23 has a cable hole 230, and a cable can enter the first accommodating space 231 through the cable hole 230 and be connected to the user interface electrical module 25.

In this embodiment, the first accommodating space 231 and the second accommodating space 237 are located between the front panel 24 and the user interface housing 23. Boundary walls of the first accommodating space 231 and the second accommodating space 237 are formed by the user interface housing 23 and the front panel 24, where the front panel 24 forms front boundary walls of the first accommodating space 231 and the second accommodating space 237. The user interface housing 23 forms rear boundary walls, upper boundary walls, and lower boundary walls of the first accommodating space 231 and the second accommodating space 237.

The user interface electrical module 25 is connected to the rear surface of the front panel 24, so as to receive an instruction input by the user by touching the front panel 24.

The door 2 includes a handle member 29 detachably accommodated in the second accommodating space 237. In the door 2, the handle member 29 may be detachably fixed on the user interface housing 23 by using a screw (not shown), so as to examine and repair the user interface electrical module 25 when necessary.

The handle member 29 closes an entrance, which is towards the second accommodating space 237, of the first accommodating space 231. When the handle member 29 is fixed on the door 2, the entrance of the first accommodating space 231 is closed, and the hand of the user cannot enter the first accommodating space 231. When the handle member 29 is detached from the door 2, the user can approach the user interface electrical module 25 through the second accommodating space 237. For example, the user interface electrical module 25 may be taken out of the first accommodating space 231, or the user interface electrical module 25 may be put into the first accommodating space 231 through the second accommodating space 237.

The handle member 29 includes a grip portion 291 located in the second accommodating space 237. The handle groove 232 is located behind the grip portion 291.

After the hand of the user enters the handle groove 232, the user can grab the grip portion 291 with fingers entering the handle groove 232, so as to open the door 2. For example, some fingers of the user are pressed on a rear surface of the grip portion 291, and another finger (for example, the thumb) is put on the front panel 24 in front of the grip portion 291, so as to apply a force to open the door 2.

The grip portion 29 includes a cover portion 292 for closing an open side of the first accommodating space 231. The grip portion 291 is connected to a front side of the cover portion 292.

The cover portion 292 separates the handle groove 232 and the first accommodating space 231. In the second accommodating space 237, the handle groove 232 is located behind the grip portion 291, and with the cover portion 292 as a side boundary, the concave portion 233 in communication with the handle groove 232 is located behind the edge notch 241 and thus exposed in front of the door 2.

A surface, which faces the handle groove 232, of the cover portion 292 may be at least substantially perpendicular to the front panel 24 that is located in front of the user interface electrical module 25 and the handle member 29, thereby being at least substantially perpendicular to the front surface 201 of the door 2. In this embodiment, the cover portion 292 is substantially plate-shaped. The grip portion 291 has a front surface that is at least substantially parallel to the front panel 24. Therefore, the handle member 29 has a cross section that is substantially L-shaped.

The front surface of the grip portion 291 is close to the front panel 24 but keeps a small gap with the rear surface of the front panel 24, for example, the grip portion 291 is close to the front panel 24 in such a manner that the gap in a front-rear direction between the grip portion 291 and the front panel 24 is not less than 0.2 millimeters but not greater than 1 millimeter. Preferably, the gap between the front surface of the grip portion 291 and the front panel 24 is between 0.2 millimeters and 0.6 millimeters, for example, the gap is 0.6 millimeters.

The handle member 29 may further include a metal reinforcement member 293, which is especially for enhancing the strength of the grip portion 291. The reinforcement member 293 extends along a length direction of the grip portion 291. In this embodiment, the reinforcement member 293 may extend over almost the entire length of the grip portion 291. Disposing the metal reinforcement member 293 on the handle member 29 helps avoid the technical problem that the grip portion 291 is deformed in the horizontal direction when the door is opened and thus applies a force on the front panel 24, causing poor contact between the user interface module 25 and the front panel 24.

The reinforcement member 293 is fixed at the handle member 29 without being exposed to the handle groove 232. In this embodiment, the handle member 29 may have a receiving portion 294, and the reinforcement member 293 is received in the receiving portion 294. The receiving portion 294 is open towards the first accommodating space 231.

The reinforcement member 293 has a shape adapted to the grip portion 291 and the cover portion 292, and therefore, a cross section of the reinforcement member 293 is also substantially L-shaped. The reinforcement member 293 includes a first reinforcement portion 2931 that extends inside the grip portion 291 and a second reinforcement portion 2932 that extends along the cover portion 292. The cover portion 292 may have multiple clamping portions 2921 and 2922 for fixing the second reinforcement portion 2932.

Figure 5:
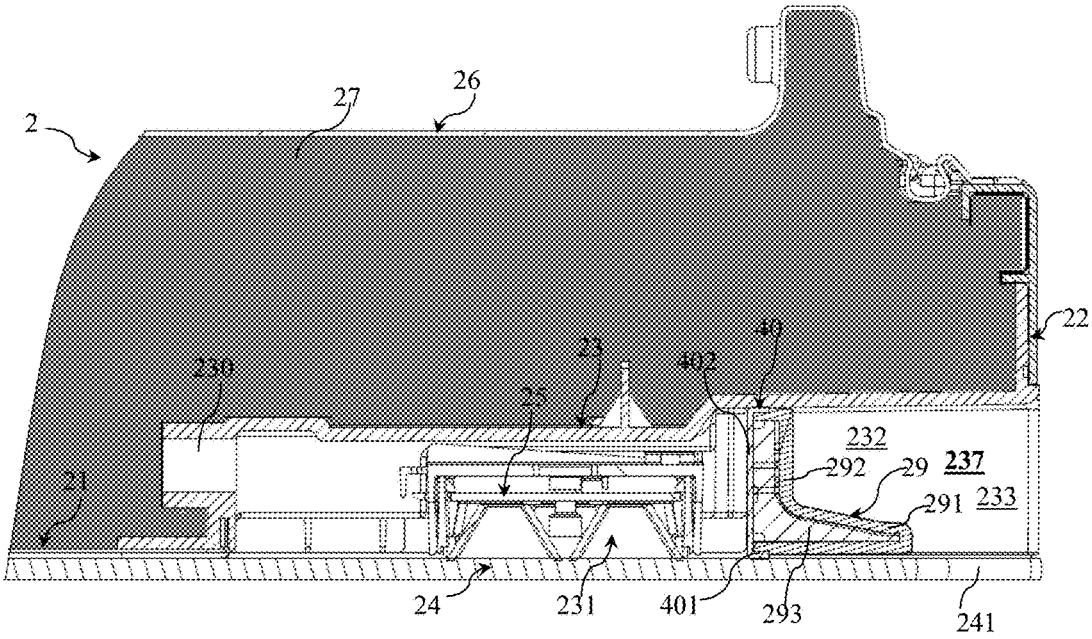
FIG. 5 is a schematic exploded diagram of a handle member and a sealing member according to a preferred embodiment of the present invention.

As shown in FIG. 4 and FIG. 5, the door 2 includes a sealing member 40, and the sealing member 40 includes a sealing portion located between the handle member 29 and at least one boundary wall of the second accommodating space 237, thereby reducing the possibility of moisture and dust entering the first accommodating space 231.

Figure 6:
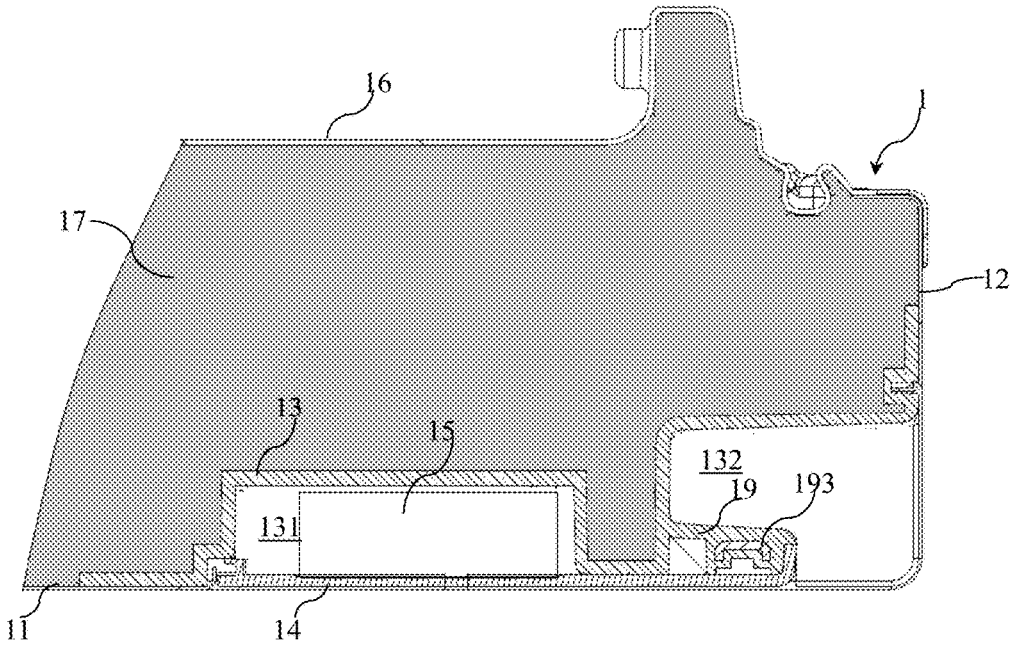
FIG. 6 and FIG. 7 are partial cross-sectional schematic diagrams according to another preferred embodiment of the present invention.

FIG. 6 and FIG. 7 are partial cross-sectional schematic diagrams according to another preferred embodiment of the present invention. As shown in FIG. 6 and FIG. 7, a door 1 used on a refrigerator includes a door liner 16, an outer wall 11 opposite to the door liner 16, a side wall 12, and a user interface housing 13 connected to the outer wall 11 and the side wall 12. The user interface housing 13 is combined with the outer wall 11, the side wall 12, and the door liner 16 by a thermal insulating layer 17 located between the outer wall 11 and the door liner 16.

In this embodiment, the outer wall 11 and the side wall 12 are made of a thin metal sheet, and is of a one-piece structure.

The door 1 includes an accommodating space 131 located in the user interface housing 13, to accommodate a user interface electrical module 15. The accommodating space 131 is open forward. A front port of the accommodating space 131 is covered by a front panel 14 that is detachably connected to the door 1.

The user interface electrical module 15 is connected to a rear surface of the front panel 14, so that the user interface electrical module 15 can receive an instruction input by a user by touching the front panel 14.

A handle groove 132 and a grip portion 19 in front of the handle groove 132 are disposed in the user interface housing 13. The grip portion 19 is integrally formed on the user interface housing 13.

The handle groove 132 and the accommodating space 131 are arranged side by side along a horizontal direction of the door 1. The handle groove 132 is located behind the front panel 14.

The grip portion 19 and the accommodating space 131 are covered by the front panel 14. A front surface of the grip portion 19 is in contact with the rear surface of the front panel 14.

A metal reinforcement member 193 is embedded in the grip portion 19, that is, the reinforcement member 193 is injection-molded as an embedded member together with the user interface housing 13 during manufacturing of the user interface housing 13, and is embedded in the user interface housing 13. Multiple reinforcing ribs 192 may further be disposed on a front side of the grip portion 19.

The reinforcement member 193 extends along a length direction of the grip portion 19, and the length of the reinforcement member 193 may be close to but is less than the length of the grip portion 19.

The reinforcement member 193 may have a cross section that is substantially U-shaped. The reinforcement member 193 may have several through holes, so that an injection molding material of the user interface housing 13 passes through these through holes and is fixed with the reinforcement member 193 more desirably.

The user interface housing 13 includes a pair of end walls 138, where each end wall 138 is connected to a corresponding end of the grip portion 19. The end walls 138 form upper and lower boundary walls of the handle groove 132. Each end portion of the grip portion 19 has a slot 194 close to the corresponding end wall 138. The slot 194 separates the reinforcement member 193 and the corresponding end wall 138. The depth of the slot 194 is set such that by means of the slot 194, a neck portion 195 close to the end wall 138 is formed on the grip portion 19, where the neck portion 195 and the reinforcement member 193 do not overlap at all in a front-rear direction of the door 1. In this way, the possibility that a joint between the grip portion 19 and the end wall 138 cracks due to different coefficients of thermal expansion of the reinforcement member 193 and the grip portion 19 is greatly reduced. It is also possible that a tail end of the reinforcement member 193 is exposed in the slot 194.

In this embodiment, because the metal reinforcement member 193 is disposed in the grip portion 19, when the door is opened, the deformation of the grip portion 19 in the front-rear direction can be significantly reduced, which helps reduce the possibility of forming an uneven gap between the grip portion 19 and the front panel 14.

Various embodiments of individual parts described with reference to FIG. 1 to FIG. 5 may be combined in any given manner, to implement the advantage of the present invention. In addition, the present invention is not limited to the shown embodiments, and in general cases, the present invention may also use means other than the shown means, as long as these means can achieve the same effect.

What is claimed is:

1. A refrigerator, comprising a door, said door including:

a handle groove having a length, said handle groove configured for accommodating at least part of a hand of a user;

a grip portion extending at least substantially the length of said handle groove, and disposed in front of said handle groove, and said grip portion disposed for at least part of a hand of the user to exert a force onto;

a front panel disposed in front of said grip portion, said front panel having a rear surface;

said grip portion being disposed in a vicinity of or in contact with said rear surface of said front panel;

at least a metal reinforcement member disposed in said grip portion, said reinforcement member extending at least substantially a length of said grip portion; and said grip portion being made of different material than said reinforcement member.

2. The refrigerator according to claim 1, wherein said reinforcement member extends along a length direction of said grip portion.

3. The refrigerator according to claim 1, wherein said metal reinforcement member is embedded in said grip portion.

4. The refrigerator according to claim 1, wherein:

said handle groove has two boundary walls;

said grip portion has two ends are each being connected to a respective one of said boundary walls;

each of said ends of said grip portion has a slot in a vicinity of a respective one of said boundary walls; and said slots separate said metal reinforcement member from said boundary walls.

5. The refrigerator according to claim 1, which further comprises a user interface electrical module connected to said rear surface of said front panel.

6. The refrigerator according to claim 5, which further comprises a user interface housing disposed in a vicinity of said handle groove, said user interface housing having an accommodating space for accommodating said user interface electrical module, and said grip portion being connected on said user interface housing.

7. The refrigerator according to claim 6, wherein said grip portion has a receiving portion, said receiving portion is open towards said accommodating space, and said reinforcement member is at least partially received in said receiving portion.

8. The refrigerator according to claim 6, wherein further comprises:

a handle member detachably connected to said user interface housing, said handle member including a cover portion integrally formed with said grip portion; and said accommodating space having an entrance being open towards said handle groove and being closed by said cover portion.

9. The refrigerator according to claim 8, wherein said reinforcement member extends into said cover portion and said grip portion.

10. The refrigerator according to claim 8, wherein said reinforcement member has a shape adapted to said grip portion and said cover portion.

11. The refrigerator according to claim 6, wherein said front panel is detachably connected to said user interface housing.

12. The refrigerator according to claim 1, wherein said grip portion and said rear surface of said front panel form a gap therebetween, and said gap has a width of between 0.2 millimeters and 1 millimeter.

13. The refrigerator according to claim 1, wherein said door has a front surface, and said front panel forms at least most of said front surface of said door.

14. A refrigerator, comprising a door, said door including:

a handle groove;

a grip portion disposed in front of said handle groove;

a front panel disposed in front of said grip portion, said front panel having a rear surface;

said grip portion being disposed in a vicinity of or in contact with said rear surface of said front panel;

at least a metal reinforcement member disposed in said grip portion;

said grip portion being made of different material than said reinforcement member;

a user interface electrical module connected to said rear surface of said front panel;

a user interface housing disposed in a vicinity of said handle groove, said user interface housing having an accommodating space for accommodating said user interface electrical module, and said grip portion being connected on said user interface housing;

a handle member detachably connected to said user interface housing, said handle member including a cover portion integrally formed with said grip portion; and said accommodating space having an entrance being open towards said handle groove and being closed by said cover portion.

* * * * *